US008402895B2

(12) United States Patent
Dupont et al.

(10) Patent No.: US 8,402,895 B2
(45) Date of Patent: Mar. 26, 2013

(54) VORTICE AMPLIFIED DIFFUSER FOR BUOYANCY DISSIPATER AND METHOD FOR SELECTABLE DIFFUSION

(75) Inventors: James H. Dupont, Bowie, AZ (US); Jeffrey H. Koessler, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 354 days.

(21) Appl. No.: 12/770,879

(22) Filed: Apr. 30, 2010

(65) Prior Publication Data

US 2012/0103424 A1 May 3, 2012

(51) Int. Cl.
*F42B 12/02* (2006.01)
*F42B 15/22* (2006.01)
*F42B 19/10* (2006.01)

(52) U.S. Cl. ..... 102/399; 102/381; 114/21.2

(58) Field of Classification Search ..... 102/367, 102/368, 369, 370, 374, 399, 381, 530; 114/316, 114/317, 318, 21.2, 21.3; 137/2, 810; 89/14.2, 89/14.3, 14.4; 239/451, 463, 505
See application file for complete search history.

(56) References Cited

U.S. PATENT DOCUMENTS

| | | | | |
|---|---|---|---|---|
| 923,922 | A | 6/1909 | Wratzke | |
| 1,222,498 | A | 4/1917 | Steinmetz | |
| 1,947,407 | A * | 2/1934 | Cornell, Jr. | 239/451 |
| 2,289,318 | A | 7/1942 | Pratt | |
| 2,334,211 | A | 11/1943 | Miller | |
| 2,466,561 | A | 4/1949 | Standal | |
| 2,557,815 | A | 6/1951 | Wheel et al. | |
| 2,693,078 | A * | 11/1954 | Laucher | 239/265.39 |
| 2,713,308 | A | 7/1955 | Brown et al. | |
| 2,779,281 | A | 1/1957 | Maurice et al. | |
| 2,954,750 | A | 10/1960 | Crump et al. | |
| 2,995,088 | A | 8/1961 | Asplund | |
| 3,109,373 | A | 11/1963 | Saffer et al. | |
| 3,316,840 | A | 5/1967 | Grand | |
| 3,358,884 | A | 12/1967 | Link | |
| 3,417,719 | A | 12/1968 | Nitenson | |
| 3,902,425 | A | 9/1975 | Kurtzemann | |
| 2,745,369 | A | 5/1976 | Brown et al. | |
| 4,047,668 | A * | 9/1977 | DeWeese et al. | 239/500 |
| 4,069,021 | A | 1/1978 | Schneider | |
| 4,092,943 | A | 6/1978 | Lund et al. | |
| 4,188,884 | A | 2/1980 | White et al. | |
| 4,249,673 | A | 2/1981 | Katoh et al. | |

(Continued)

OTHER PUBLICATIONS

"U.S. Appl. No. 12/362,547, Advisory Action mailed Jan. 4, 2010", 2 pgs.

(Continued)

*Primary Examiner* — Bret Hayes
(74) *Attorney, Agent, or Firm* — Schwegman Lundberg & Woessner, P.A.

(57) ABSTRACT

Embodiments of a vortice-amplified diffuser section for use in a buoyancy dissipater are generally described herein. The vortice-amplified diffuser section may include a plurality of diffusion ports to diffuse an expanding gas, a reduction sleeve to adjust an amount of diffusion flow, and vortex generators within at least some of the diffusion ports to generate vortices. The reduction sleeve may be configurable to block off some of the diffusion ports. The vortex generators may generate vortices of gas bubbles in the water to reduce the water's buoyancy and to inhibit movement or disrupt the operations of an errant vessel. The reduction sleeve may be used to control the size, shape, and intensity of the expanding gas bubble or bubble plume as well as to control the lethality level of the buoyancy reduction.

18 Claims, 4 Drawing Sheets

U.S. PATENT DOCUMENTS

| | | | | |
|---|---|---|---|---|
| 5,654,523 | A * | 8/1997 | Brunn | 102/498 |
| 6,145,459 | A | 11/2000 | Takahashi et al. | |
| 6,164,565 | A * | 12/2000 | Adee et al. | 239/333 |
| 6,186,085 | B1 | 2/2001 | Kato et al. | |
| 6,581,521 | B1 * | 6/2003 | Dixon et al. | 102/368 |
| 6,655,313 | B1 | 12/2003 | Woodall et al. | |
| 6,701,819 | B1 | 3/2004 | Williams et al. | |
| 6,899,290 | B2 * | 5/2005 | Varble et al. | 239/533.12 |
| 6,938,840 | B1 * | 9/2005 | Trutschel et al. | 239/533.12 |
| 6,962,121 | B1 | 11/2005 | Kuklinski | |
| 7,059,544 | B2 * | 6/2006 | Leonard et al. | 239/398 |
| 7,067,732 | B1 | 6/2006 | Kuklinski | |
| 7,185,588 | B2 | 3/2007 | Clark et al. | |
| 7,730,838 | B1 | 6/2010 | Dupont et al. | |
| 7,789,009 | B1 * | 9/2010 | Brittingham | 89/14.4 |
| 7,895,948 | B2 * | 3/2011 | Dupont et al. | 102/399 |
| 2002/0139287 | A1 | 10/2002 | Chase | |
| 2004/0200374 | A1 * | 10/2004 | Sansolo | 102/367 |
| 2005/0047870 | A1 | 3/2005 | Rode | |
| 2010/0192798 | A1 | 8/2010 | Dupont et al. | |

OTHER PUBLICATIONS

"U.S. Appl. No. 12/362,547, Final Office Action mailed Oct. 29, 2009", 6 pgs.
"U.S. Appl. No. 12/362,547, Non-Final Office Action mailed Jul. 9, 2009", 11 pgs.
"U.S. Appl. No. 12/362,547, Response filed Jan. 8, 2010 to Adivosry Action mailed Jan. 4, 2010", 7 pgs.
"U.S. Appl. No. 12/362,547, Response filed Dec. 17, 2009 to Final Office Action mailed Oct. 29, 2009", 11 pgs.
"U.S. Appl. No. 12/362,547, Response to Non Final Office Action mailed Jul. 9, 2009", 12 pgs.
"U.S. Appl. No. 12/698,611, Non-Final Office Action mailed Jun. 18, 2010", 8 Pgs.
"U.S. Appl. No. 12/698,611, Response filed Sep. 15, 2010 to Non Final Office Action mailed Jun. 18, 2010", 7 pgs.
"U.S. Appl. No. 12/362,547, Notice of Allowance mailed Jan. 28, 2010.", 4 Pgs.
"U.S. Appl. No. 12/770,890 , Response filed Aug. 1, 2012 to Non Final Office Action mailed Apr. 30, 2012", 12 pgs.
"U.S. Appl. No. 12/770,890, Notice of Allowance mailed Sep. 26, 2012", 7 pgs.

* cited by examiner

VORTICE AMPLIFIED DIFFUSER FOR BUOYANCY DISSIPATER AND METHOD FOR SELECTABLE DIFFUSION

GOVERNMENT RIGHTS

This invention was not made with United States Government support. The United States Government does not have any rights in this invention.

RELATED APPLICATIONS

This application is related to co-pending patent application entitled "BUOYANCY DISSIPATER AND METHOD TO DETER AN ERRANT VESSEL" filed Jan. 30, 2009 having Ser. No. 12/362,547 which is incorporated herein by reference.

This application is related to co-pending patent application entitled "BUOYANCY DISSIPATER AND METHOD TO DETER AN ERRANT VESSEL" filed Feb. 2, 2010 having Ser. No. 12/698,611 which is incorporated herein by reference.

This application is related to patent application entitled "BUBBLE WEAPON SYSTEM AND METHODS FOR INHIBITING MOVEMENT AND DISRUPTING OPERATIONS OF VESSELS" Ser. No. 12/770,890 filed concurrently herewith and incorporated herein by reference.

TECHNICAL FIELD

Embodiments pertain to diffusers for buoyancy dissipaters and methods for generating vortices. Some embodiments pertain to inhibiting movement of vessels by buoyancy reduction of water. Some embodiments pertain to harbor security. Some embodiments pertain to controlling lethality levels of a non-lethal interdiction weapon (NLIW).

BACKGROUND

Buoyancy reduction of water can be used to inhibit motion of an errant vessel as well as disrupt operations of the vessel by generating an expanding gas bubble or bubble plume near or under the vessel. One issue with buoyancy reduction is controlling the size, shape, and intensity of the expanding gas bubble or bubble plume. By controlling the size, shape, and intensity of the expanding gas bubble or bubble plume, the lethality level may be controlled. This is particularly beneficial in situations in which an errant vessel needs to be stopped without injury to the persons on board.

Thus, there are general needs for apparatus that can control the size, shape, and intensity of the expanding gas bubble or bubble plume as well as a method to control the lethality level of the buoyancy reduction.

DETAILED DESCRIPTION

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

Figure 1:
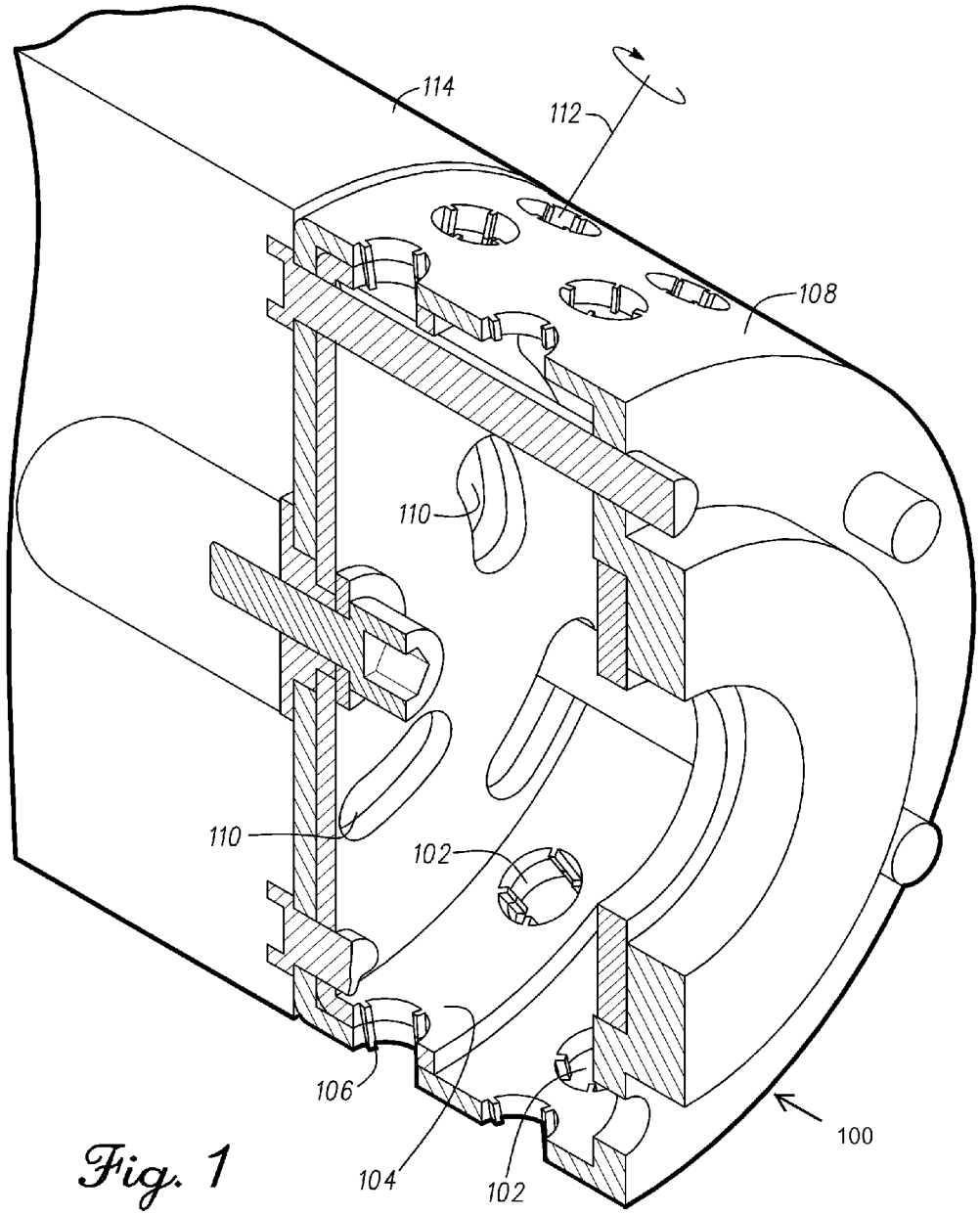
FIG. 1 illustrates a vortice-amplified diffuser section in accordance with some embodiments.

FIG. 1 illustrates a vortice-amplified diffuser section in accordance with some embodiments. The vortice-amplified diffuser section 100 may be used as part of a buoyancy dissipater. The vortice-amplified diffuser section 100 may include a plurality of diffusion ports 102 to diffuse an expanding gas, a reduction sleeve 104 to adjust an amount of diffusion flow, and vortex generators 106 within at least some of the diffusion ports 102. The vortex generators 106 may generate vortices 112 of gas bubbles in the water. The reduction sleeve 104 may be configurable to block off some of the diffusion ports 102. The vortices 112 of gas bubbles may result in a bubble plume that may reduce the water's buoyancy and may inhibit movement or disrupt the operations of an errant vessel. The reduction sleeve 104 may be used to control the size, shape, and intensity of the expanding gas bubble or bubble plume as well as to control the lethality level of the buoyancy reduction. The diffusion ports 102 may be provided circumferentially around a housing 108 of the vortice-amplified diffuser section 100 as illustrated.

In these embodiments, blocking one or more of the diffusion ports 102 may inhibit the mass flow rate and may serve to delay the diffusion event (e.g., the generation of a bubble plume). A high rate of gas flow with less gas may also be provided. In this way vortex intensity and bubble diameter of bubbles of the bubble plume may be maintained. In some embodiments, the reduction sleeve 104 may be configured to block of a predetermined portion of the diffusion ports 102 when diffusion reduction is selected.

In some embodiments, the vortice-amplified diffuser section 100 may include one or more thrusting ports 110 provided at an end of the vortice-amplified diffuser section 100. The one or more thrusting ports 110 may be configured to generate thrust. In some embodiments described in more detail below, the thrusting ports 110 may be provided behind nose-cone fairing 114.

In the embodiments of the vortice-amplified diffuser section 100 illustrated in FIG. 1, two rows of diffusion ports 102 are provided circumferentially around the housing 108. In these embodiments, the reduction sleeve 104 may be configured to partially or fully block off one row of the diffusion ports 102. In other embodiments, the vortice-amplified diffuser section 100 may include more than two rows of diffusion ports 102 and the reduction sleeve 104 may be configured to partially or fully block off more than one row of the diffusion ports 102.

Figure 2:
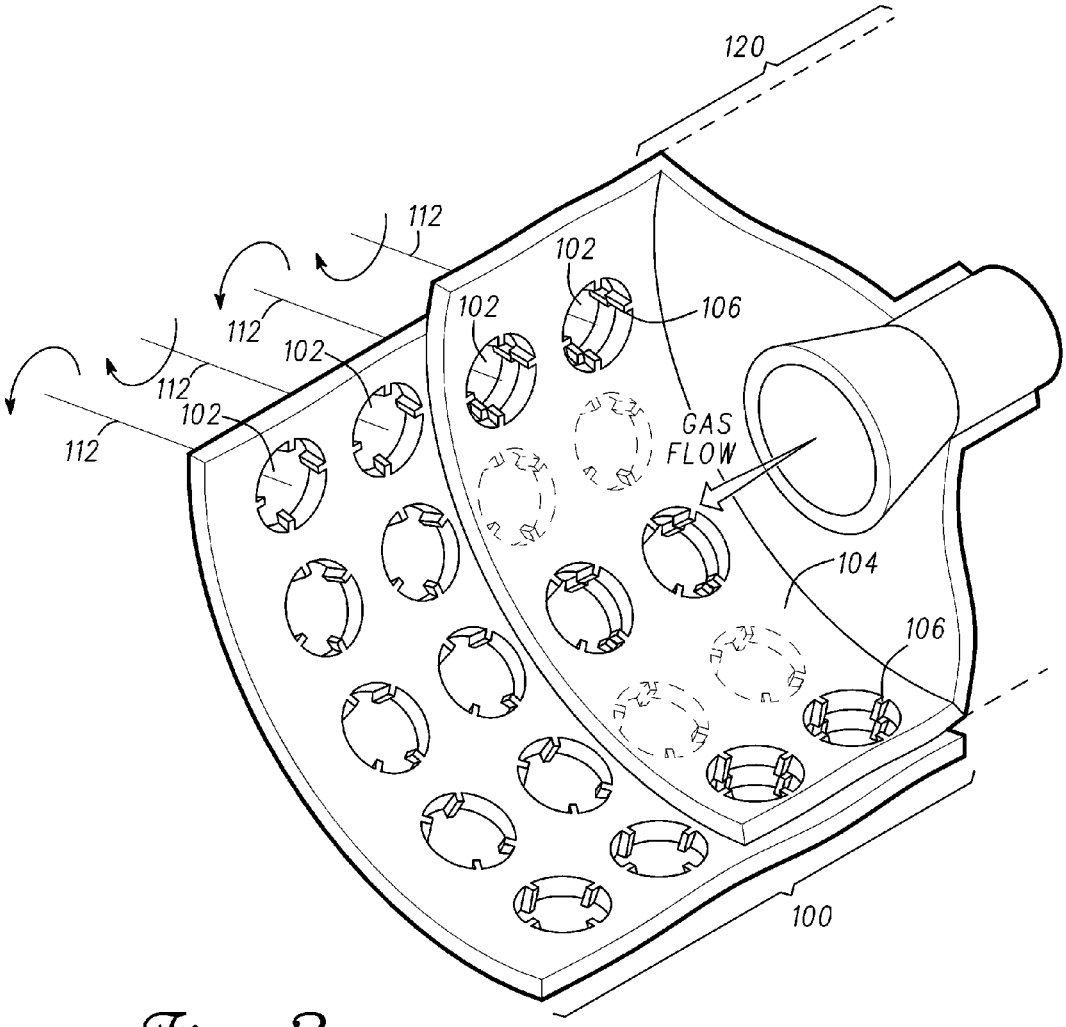
FIG. 2 illustrates a portion of a buoyancy dissipater including a vortice-amplified diffuser section in accordance with some embodiments.

FIG. 2 illustrates a portion of a buoyancy dissipater including a vortice-amplified diffuser section 100 in accordance with some embodiments. As shown in FIG. 2, the vortices 112 may be generated by an expanding gas released into the diffuser section from a pressure vessel section 120. As further illustrated, the vortex generators 106 may comprise angled tabs that control vortex rotation. In these embodiments, the greater the tabs are angled, the greater the rotation of the vortices 112. The angle of the tabs may also determine whether the rotation of the vortices 112 will be clockwise or counterclockwise. In embodiments in which the vortice-amplified diffuser section 100 is fabricated from a metal such as steel, the vortex generators 106 may comprise tabs that are welded within the diffusion ports 102 at a predetermined angle. In the embodiments illustrated in FIG. 2, four rows of diffusion ports 102 are provided circumferentially and the reduction sleeve 104 is configured to partially or fully block off two rows of the diffusion ports 102.

As illustrated in FIG. 1 and FIG. 2, in some embodiments, the reduction sleeve 104 may be rotatable within the vortice-amplified diffuser section 100 to selectively block off a portion of the diffusion ports 102 to reduce the overall diffusion flow from the diffusion ports 102. In these embodiments, the vortice-amplified diffuser section 100 may be cylindrical shaped with the diffusion ports 102 provided circumferentially around the housing 108 of the vortice-amplified diffuser section 100. The reduction sleeve 104 may be cylindrical shaped and configured to rotate within the housing 108 of the vortice-amplified diffuser section 100.

In some of these embodiments, the reduction sleeve 104 may be internal and on the inside with respect to the diffusion ports 102, although this is not a requirement. In other embodiments, the reduction sleeve 104 may be external and on the outside with respect to the diffusion ports 102. In some embodiments, the reduction sleeve 104 may be clocked to a selected position within the housing 108 to block off a predetermined portion of the diffusion ports 102 for each selected position.

In some embodiments, the diffusion ports 102 may be provided circumferentially around a primary full sleeve, and the reduction sleeve 104 may comprise a secondary half-sleeve that is rotatable within the primary full sleeve to block off a portion of the diffusion ports 102 to reduce the diffusion flow.

In some of these embodiments, the vortice-amplified diffuser section 100 utilizes a manual sleeve setting to adjust the number of open diffusion ports 102 to reduce the mass flow rate by controlling the mass flow exit area. The reduction sleeve 104 may be used in conjunction with the vortex generators 106 to restrict and intensify the expanding gas locally. In these embodiments, the bubble plume of expanding gas may be shaped by changing which diffusion ports 102 are used as well as restricting the mass flow rate.

In some embodiments, a first portion of the diffusion ports 102 may include vortex generators 106 that are angled to generate vortices 112 with a clockwise rotation and a second portion of the diffusion ports 102 may include vortex generators 106 angled to generate vortices 112 with a counterclockwise rotation. In these embodiments, the diffusion ports 102 that generate vortices 112 with the clockwise rotation and the diffusion ports 102 that generate vortices 112 with the counterclockwise rotation may be provided in an alternating fashion circumferentially around the vortice-amplified diffuser section 100. The alternating of the rotation of the vortices 112 may help offset any torque induced by rotation of the vortices 112.

Although FIG. 2 illustrates that all of the diffusion ports 102 have vortex generators 106, the scope of the embodiments is not limited in this respect. In some embodiments, a first plurality of the diffusion ports 104 may have the vortex generators 106 and a second plurality of the diffusion ports 102 may be provided without the vortex generators 106. In these embodiments, the plurality of diffusion ports 102 that include vortex generators 106 may be referred to as vortex-generating diffusion ports. In some of these embodiments, the reduction sleeve 104 may be configured to block off the diffusion ports 102 of the second plurality when diffusion reduction is selected. In these embodiments, the diffusion ports 102 without vortex generators 106 are blocked off to allow the vortice-amplified diffuser section 100 to maintain a high rate of gas flow with less gas by diffusing the gas through the diffusion ports 102 with the vortex generators 106. This may help maintain the lethality of a buoyancy dissipater while using less gas.

Referring to FIG. 1, in some embodiments, the vortice-amplified diffuser section 100 may include one or more thrusting ports 110 provided at an end of the vortice-amplified diffuser section 100 to generate thrust. In these embodiments when the one or more thrusting ports 110 are opened, the vortice-amplified diffuser section 100 may generate thrust using the same expanding gas that is used to generate the vortices 112. In some embodiments, the thrusting ports 110 may be configurable to vary an amount of thrust. In some embodiments, the expanding gas may be provided through an orifice from the pressure vessel section 120 as illustrated in FIG. 2. In some embodiments, the one or more thrusting ports 110 may be configured to help keep the buoyancy dissipater stationery when the diffusion ports 102 are generating a bubble plume.

In some of these embodiments, the thrusting ports 110 may be provided behind a nose cone fairing 114 of the buoyancy dissipater. These embodiments are described in more detail below.

Figure 3:
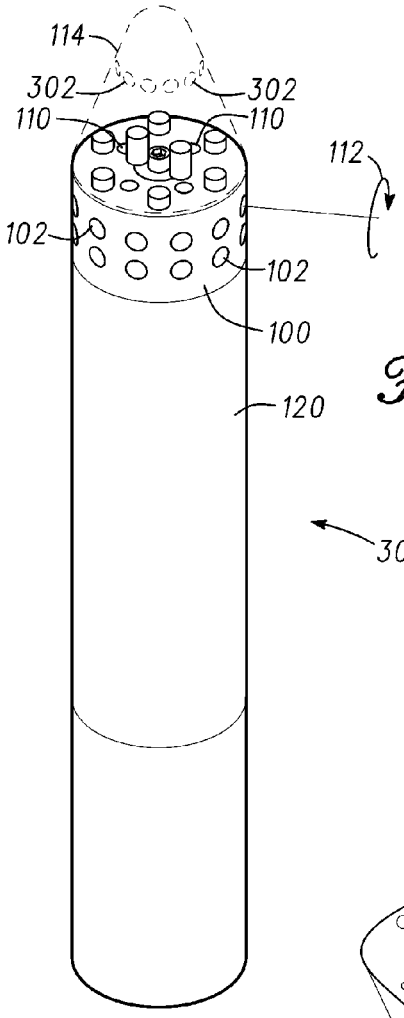
FIG. 3 illustrates a buoyancy dissipater in accordance with some embodiments.

FIG. 3 illustrates a buoyancy dissipater in accordance with some embodiments. Buoyancy dissipater 300 includes a vortice-amplified diffuser section 100 with diffusion ports 102, a pressure vessel section 120 and a nose cone fairing 114. In these embodiments, the pressure vessel 120 may release an expanding gas into the vortice-amplified diffuser section 100. Vortices 112 may be generated by diffusion ports 102. The vortice-amplified diffuser section 100 may be configurable to control the size, shape, and intensity of an expanding gas bubble or bubble plume.

As illustrated in FIG. 3, the vortice-amplified diffuser section 100 may include one or more thrusting ports 110. The use of thrusting ports 110 may allow the buoyancy dissipater to propel itself through the water and control its depth.

In some of these embodiments, the nose cone fairing 114 may be configured to be blown-off by the expanding gas that is provided through the one or more thrusting ports 110. In some alternate embodiments, the nose cone fairing 114 may comprise vent-holes 302 to allow the expanding gas from the thrusting ports 110 to exit the nose cone fairing 114 for generating thrust. In these alternate embodiments, the nose cone fairing 114 is not configured to be blown-off by the expanding gas that is provided through the one or more thrusting ports 110. In some of these alternate embodiments, the vent-holes 302 may be aligned with the trusting ports 110 although this is not a requirement.

In some of these embodiments, the one or more thrusting ports 110 may be reverse-thrusting ports and provided circumferentially within the nose cone fairing 114 of the buoyancy dissipater 300. In these embodiments, the reverse-thrusting ports are provided on a front end of the buoyancy dissipater.

In some embodiments, vortice-amplified diffuser section 100 may include diffusion control circuitry to control the position of the reduction sleeve 104 (FIGS. 1 and 2). The diffusion control circuitry may be responsive to a diffusion reduction signal to block off a portion of the diffusion ports 102 when diffusion reduction is selected. In this way, the buoyancy of the water as well as the shape of the expanding gas bubble or bubble plume may be controlled based on the type and size of the vessel whether or not lethality is intended. These embodiments are discussed in more detail below.

In some embodiments, the reduction sleeve 104 may be manually positionable. The position may remain fixed after the buoyancy dissipater 300 is deployed.

Figure 4:
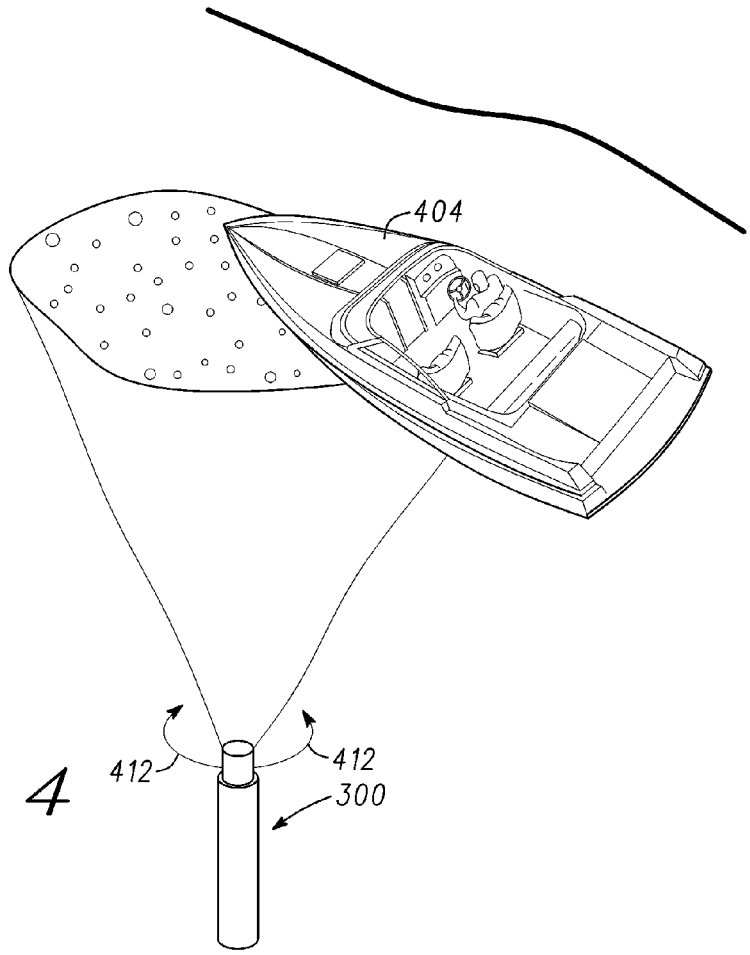
FIG. 4 illustrates the operation of a buoyancy dissipater in accordance with some embodiments.

FIG. 4 illustrates the operation of a buoyancy dissipater in accordance with some embodiments. Buoyancy dissipater 300 may correspond to buoyancy dissipater 300 (FIG. 3) and may be configured to generate a plume of gas bubbles in the water to reduce the buoyancy of the water. The reduced-buoyancy water may be used to inhibit movement of a vessel 404. As illustrated in FIG. 4 by arrows 412, the generation of vortices with vortex generators 106 (FIGS. 1 and 2) may improve the lateral gas velocity and intensity by focusing a vortex swirl locally. This may help maintain a more constant plume shape (e.g., the bubble plume impact circumference) and may reduce the total gas volume used over time. The effectiveness of the buoyancy dissipater 300 as a weapon for inhibiting the movement of the vessel 404 is thereby improved.

Figure 5:
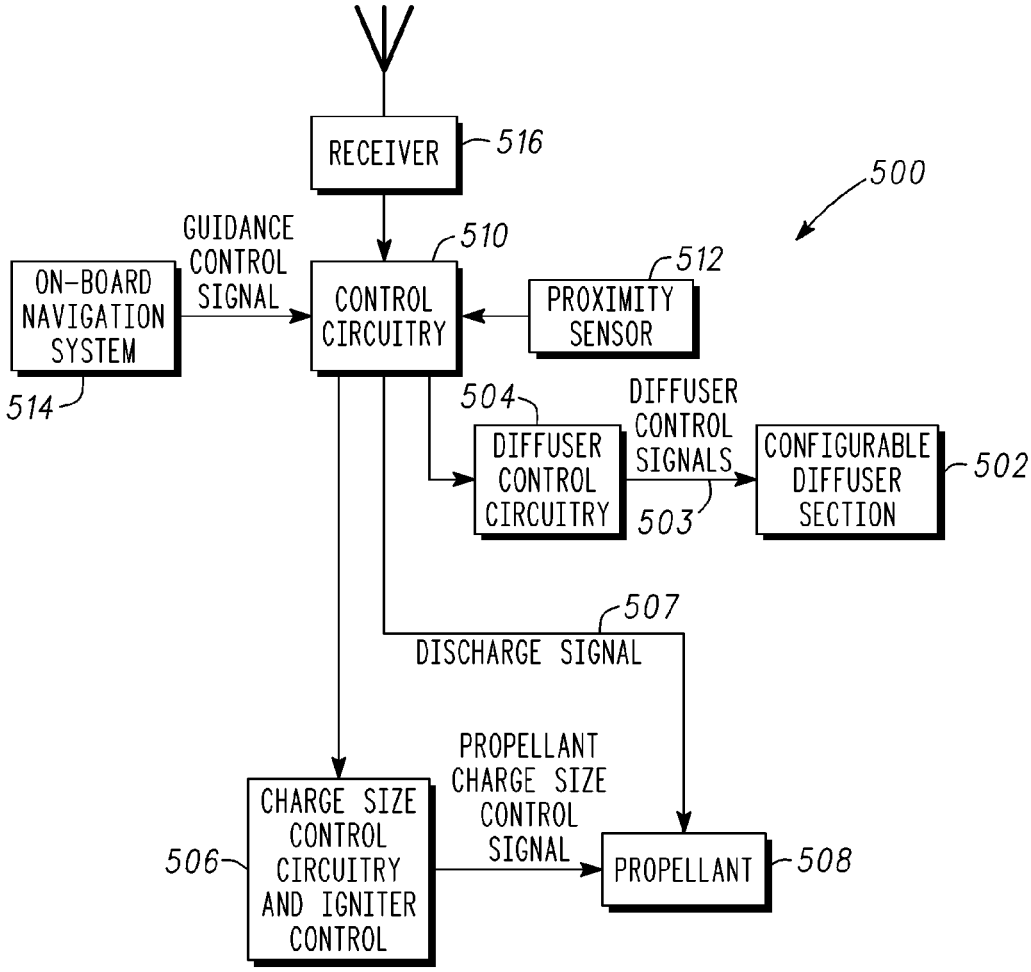
FIG. 5 illustrates a functional block diagram of a buoyancy dissipater in accordance with some embodiments.

FIG. 5 illustrates a functional block diagram of a buoyancy dissipater in accordance with some embodiments. Buoyancy dissipater 500 may be suitable for use as any one or more of the buoyancy dissipaters described above, such as buoyancy dissipater 300 (FIGS. 3 and 4). The buoyancy dissipater 500 may comprise, among other things, a configurable diffuser section 502 and diffuser control circuitry 504. The configurable diffuser section 502 may correspond to vortice-amplified diffuser section 100 (FIGS. 1, 2 and 3) described previously.

In accordance with these embodiments, the diffuser control circuitry 504 may provide diffuser control signals 503 to configure the configurable diffuser section 502 to adjust the amount of diffusion flow through the diffusion ports 102 (FIGS. 1 and 2). In some embodiments, the diffuser control circuitry 504 may control the position of the reduction sleeve 104 (FIGS. 1 and 2) to either partially or fully block off one or more of the diffusion ports 102. In some embodiments, the diffuser control circuitry 504 may be configured to provide a plurality of pre-set lethality levels of the buoyancy dissipater 500.

In some embodiments, the diffuser control signals 503 may further configure the configurable diffuser section 502 to operate in either a thrust-engaged configuration or a thrust-neutral configuration by controlling the opening or closing of thrusting ports 110 (FIG. 1). When configured to operate in the thrust-neutral configuration, the diffuser section 502 is configured to generate a neutral thrust when generating a bubble plume in order to keep the buoyancy dissipater 500 in a stationary location. When configured to operate in the thrust-engaged configuration, the diffuser section 502 is configured to generate a predetermined amount of thrust when generating a bubble plume in order to propel the buoyancy dissipater 500 through water.

In some embodiments, the buoyancy dissipater 500 may also include propellant charge-size control circuitry 506 to vary a charge size to control an amount of propellant 508 that is ignited in order to vary an amount of gas generated when generating a bubble plume. In some embodiments, the buoyancy dissipater 500 may also include control circuitry 510 to control the operations of the buoyancy dissipater 500. In some embodiments, the buoyancy dissipater 500 may also include one or more optional proximity sensors 512 to detect the proximity of a vessel. In some embodiments, the buoyancy dissipater 500 may also include an on-board navigation system 514 and accompanying sensors for use in navigating through water. In some embodiments, the buoyancy dissipater 500 may also include a wireless or wired receiver 516 for receiving command and control signals. In some embodiments, the buoyancy dissipater 500 may also include a transceiver, to transmit images, location or other data.

In response to a discharge signal 507, the propellant 508 may be ignited within the pressure vessel section 120 (FIG. 2) and discharged into the configurable diffuser section 502 to generate an expanding gas bubble or a bubble plume. In some embodiments, the discharge signal 507 may ignite a selected portion of the propellant 508 to control the amount of gas that is generated. The size and the type of the expanding gas bubble or bubble plume may be based on the configuration selected for the configurable diffuser section 502 as well as the amount of propellant 508 that is selected.

In some embodiments, the buoyancy dissipater described in the U.S. patent application, entitled "BUOYANCY DISSIPATER AND METHOD TO DETER AN ERRANT VESSEL" filed Jan. 30, 2009 having Ser. No. 12/362,547 and which is incorporated, herein by reference, may be suitable for use as any one of the buoyancy dissipaters described herein. In some embodiments, the bubble weapon described in patent application entitled "BUBBLE WEAPON SYSTEM AND METHODS FOR INHIBITING MOVEMENT AND DISRUPTING OPERATIONS OF VESSELS" having filed concurrently herewith and which is incorporated herein by reference may be suitable for use as buoyancy dissipater 500.

Although buoyancy dissipater 500 is illustrated as having several separate functional elements, one or more of the functional elements may be combined and may be implemented by combinations of software-configured elements, such as processing elements including digital signal processors (DSPs), and/or other hardware elements. For example, some elements may comprise one or more microprocessors, DSPs, application specific integrated circuits (ASICs) and combinations of various hardware and logic circuitry for performing at least the functions described herein. In some embodiments, the functional elements may refer to one or more processes operating on one or more processing elements.

In some embodiments, a method for buoyancy reduction is provided. In these embodiments, the method may include generating vortices of gas bubbles below a waterline with a plurality of diffusion ports having vortex generators therein, and adjusting an amount of diffusion flow by blocking off one or more of the diffusion ports with a reduction sleeve. By blocking off one or more of the diffusion ports, at least one of a size, shape, and intensity of an expanding gas bubble is controlled. In some embodiments, generating the vortices may comprise expanding a gas, diffusing the expanding gas through the diffusion ports, and inducing rotation with angled tabs within the diffusion ports. The angled tabs may operate as vortex generators 106 (FIGS. 1 and 2). In some embodiments, the method may include generating thrust with one or more thrusting ports 110 using the expanding gas The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A vortice-amplified diffuser section comprising:

a plurality of diffusion ports provided circumferentially around a primary full sleeve of a cylindrical diffusion section housing;

a cylindrical reduction sleeve to adjust an amount of diffusion flow through the diffusion ports, the reduction sleeve includes a secondary half sleeve rotatable within the primary full sleeve of the diffusion section housing to selectively block off a portion of one or more of the diffusion ports to reduce the diffusion flow from the portions of diffusion ports that are not blocked off; and vortex generators within at least some of the diffusion ports to generate vortices of gas bubbles, the vortex generators include angled tabs to control vortex rotation, the vortices generated by expanding gas released into the diffuser section.

2. The vortice-amplified diffuser section of claim 1 wherein a first portion of the diffusion ports include the vortex generators angled to generate vortices with a clockwise rotation, and wherein a second portion of the diffusion ports include the vortex generators angled to generate vortices with a counterclockwise rotation.

3. The vortice-amplified diffuser section of claim 1 wherein the plurality of diffusion portions include a first plurality having the vortex generators and a second plurality of diffusion ports without the vortex generators.

4. The vortice-amplified diffuser section of claim 3 wherein the reduction sleeve is configured to block off the diffusion ports of the second plurality when diffusion reduction is selected.

5. The vortice-amplified diffuser section of claim 1 further comprising one or more thrusting ports provided at an end of the vortice-amplified diffuser section to generate thrust.

6. The vortice-amplified diffuser section of claim 5 wherein the one or more thrusting ports are provided behind a nose cone fairing of the buoyancy dissipater.

7. The vortice-amplified diffuser section of claim 1 further comprising diffusion-control circuitry to control a position of the reduction sleeve, wherein the diffusion control circuitry is responsive to a diffusion reduction signal to block off a portion of the diffusion ports when diffusion reduction is selected.

8. The vortice-amplified diffuser section of claim 1 wherein the reduction sleeve is manually positionable, the position to remain fixed after the buoyancy dissipater is deployed.

9. A buoyancy dissipater comprising:

a diffuser section including:

a plurality of diffusion ports formed in a diffuser section housing, and a reduction sleeve movably coupled with the diffuser section housing, and movable relative to plurality of diffusion ports; and a pressure vessel to release an expanding gas into the diffuser section;

wherein the diffuser section is configurable through movement of the reduction sleeve relative to the housing to control at least one of a size, shape, and intensity of an expanding gas bubble by either partially or fully blocking off one or more of the diffusion ports.

10. The buoyancy dissipater of claim 9 wherein the diffuser section is a vortice-amplified diffuser section comprising a plurality of vortex-generating diffusion ports, and vortex generators within at least some of the diffusion ports to generate vortices of gas bubbles.

11. The buoyancy dissipater of claim 10 wherein the vortices are generated by an expanding gas released into the diffuser section, and wherein the vortex generators comprise angled tabs to control vortex rotation.

12. The buoyancy dissipater of claim 10 wherein the diffuser section further comprises one or more thrusting ports provided at an end of the vortice-amplified diffuser section to generate thrust, the one or more thrusting ports are provided behind a nose cone fairing of the buoyancy dissipater.

13. The buoyancy dissipater of claim 12 wherein the nose cone fairing is configured to be blown-off by the expanding gas provided through the one or more thrusting ports.

14. The buoyancy dissipater of claim 12 wherein the nose cone fairing comprises vent-holes to allow the expanding gas provided from the thrusting ports to exit the nose cone fairing to generate thrust.

15. A method for buoyancy reduction comprising:

generating vortices of gas bubbles below a waterline with a plurality of diffusion ports having vortex generators therein; and adjusting an amount of diffusion flow by blocking off one or more of the diffusion ports with a reduction sleeve; and wherein adjusting of the amount of the diffusion flow includes moving a reduction relative to the plurality of diffusion ports, the reduction sleeve movable between open and blocked configurations:

in the open configuration the reduction sleeve is offset from the plurality of diffusion ports, and in the blocked configuration at least a portion of the reduction sleeve extends over a portion of one or more of the plurality of diffusion ports.

16. The method of claim 15 wherein by blocking off one or more of the diffusion ports, at least one of a size, shape, and intensity of an expanding gas bubble is controlled.

17. The method of claim 16 wherein generating the vortices comprises:

expanding a gas;

diffusing the expanding gas through the diffusion ports; and inducing rotation with angled tabs within the diffusion ports.

18. The method of claim 17 further comprising generating thrust with one or more thrusting ports using the expanding gas.

* * * * *